US008297161B2

(12) United States Patent
Münzner

(10) Patent No.: US 8,297,161 B2
(45) Date of Patent: Oct. 30, 2012

(54) FLARE MUNITION FOR BATTLEFIELD ILLUMINATION

(75) Inventor: Sebastian Münzner, Dänischenhagen (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 93 days.

(21) Appl. No.: 12/681,746

(22) PCT Filed: Sep. 6, 2008

(86) PCT No.: PCT/EP2008/007305

§ 371 (c)(1),
(2), (4) Date: Jul. 20, 2010

(87) PCT Pub. No.: WO2009/046800

PCT Pub. Date: Apr. 16, 2009

(65) Prior Publication Data

US 2010/0288885 A1 Nov. 18, 2010

(30) Foreign Application Priority Data

Oct. 5, 2007 (DE) ..... 10 2007 048 074

(51) Int. Cl.

| | |
|---|---|
| ***F42B 4/28*** | (2006.01) |
| ***F42B 12/42*** | (2006.01) |
| ***F42B 10/56*** | (2006.01) |
| ***B64D 17/00*** | (2006.01) |

(52) U.S. Cl. ..... 89/1.11; 102/293; 102/387; 244/142; 362/382; 362/249.02; 362/800

(58) Field of Classification Search ..... 102/336, 102/337, 338, 339, 340, 386, 387, 482, 293; 89/1.11, 1.1, 1.51; 362/249.01, 249.02, 184, 800, 382; 250/504 R; 244/142, 149, 150
See application file for complete search history.

(56) References Cited

U.S. PATENT DOCUMENTS

| | | | | |
|---|---|---|---|---|
| 1,781,621 A | | 11/1930 | Wiley | |
| 4,934,273 A | | 6/1990 | Endriz | |
| 5,222,798 A | * | 6/1993 | Adams | 362/110 |
| 5,481,979 A | * | 1/1996 | Walder | 102/498 |

(Continued)

FOREIGN PATENT DOCUMENTS

DE 2648617 A * 5/1978

(Continued)

OTHER PUBLICATIONS

International Search Report, issued in corresponding European Application PCT/EP2008/007305, mailed Feb. 5, 2009, mailed Feb. 16, 2009.

(Continued)

*Primary Examiner* — James Bergin
(74) *Attorney, Agent, or Firm* — Griffin & Szipl, P.C.

(57) ABSTRACT

Flare munition for battlefield illumination is provided that includes: (a) at least one electrical flare body; (b) an electrical energy source connectable with the flare body; and (c) an electrical or electronic control device for connecting the electrical flare body with the source of energy during a specified time interval. The flare munition can be fired from a weapon or can be launched as a bomb and allows safe and simple subsequent recovery of the corresponding flare body because no pyrotechnic flare charge is used. Instead, an electrical flare body is used that emits light in the visible and/or infrared wavelength range depending on its intended purpose.

15 Claims, 1 Drawing Sheet

U.S. PATENT DOCUMENTS

| | | | | |
|---|---|---|---|---|
| 5,661,257 | A * | 8/1997 | Nielson et al. | 102/334 |
| 6,840,177 | B1 * | 1/2005 | Hatteland | 102/361 |
| 2008/0185949 | A1 * | 8/2008 | Jebsen et al. | 313/231.41 |

FOREIGN PATENT DOCUMENTS

| | | | |
|---|---|---|---|
| DE | 197 34 144 | A1 | 2/1999 |
| FR | 2867616 | A1 * | 9/2005 |
| GB | 2 387 644 | A | 10/2003 |

OTHER PUBLICATIONS

Rüdiger Paschotta, Encyclopedia of Laser Physics and Technology—semiconductor lasers, at http://www.rp-photonics.com/semiconductor_lasers.html (Last Updated Feb. 16, 2011), six pages.

"LEDs and Laser Diodes" (Electus Distribution 2001), 3 pages.

Samuel M. Goldwasser, "Sam's Laser FAQ—Diode Lasers," at http://www.repairfaq.org/sam/laserdio.htm (2012), downloaded Mar. 16, 2012), 135 pages.

"Laserdiode—Wikipedia," at http://de.wikipedia.org/wiki/Laserdiode, downloaded Mar. 16, 2012, five pages, along with a Google English translation.

* cited by examiner

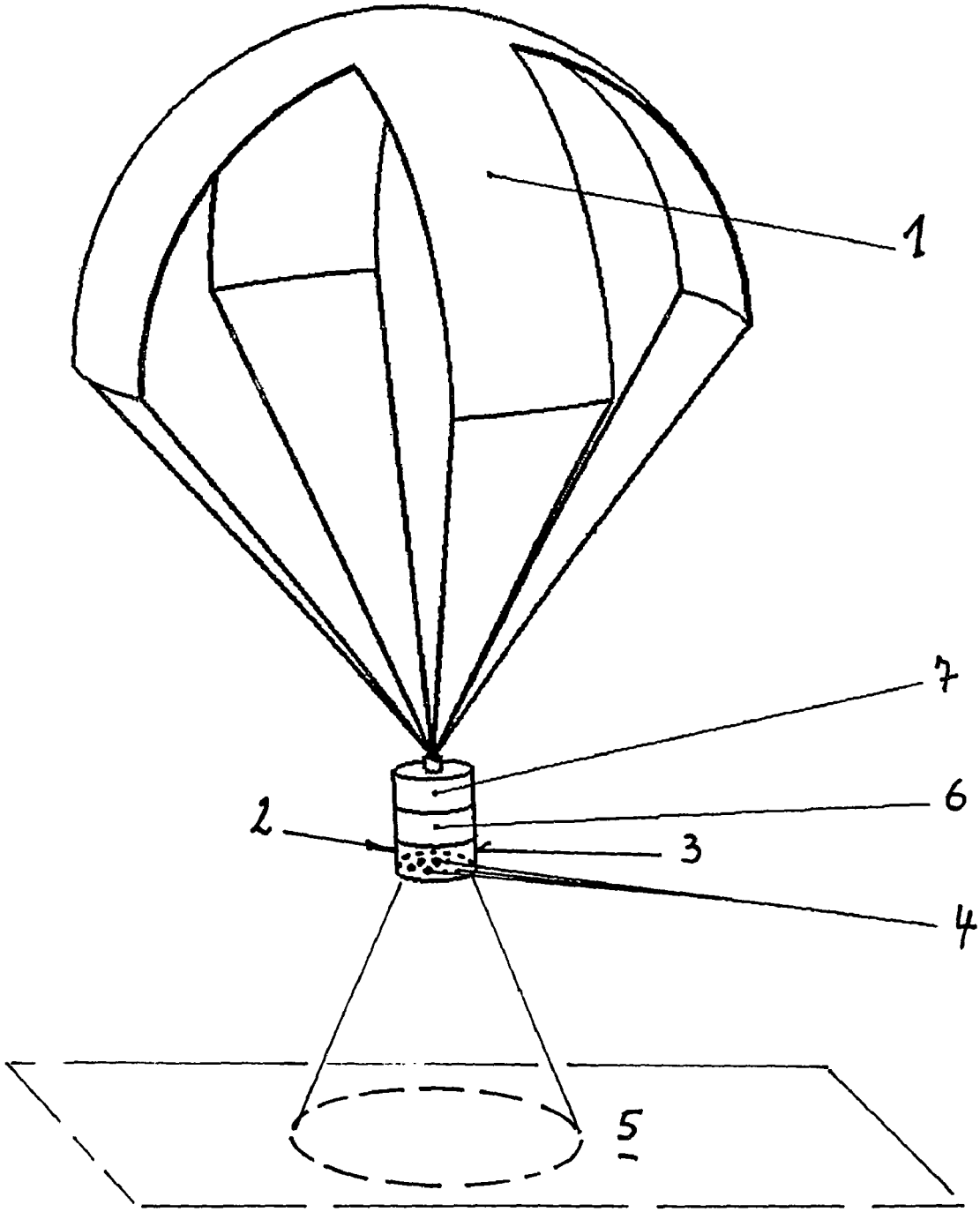
1
7
6
2
3
4
5

FLARE MUNITION FOR BATTLEFIELD ILLUMINATION

This is a National Phase Application in the United States of International Patent Application No. PCT/EP2008/007305 filed Sep. 6, 2008, which claims priority on German Patent Application No. DE 10 2007 048 074.3, filed Oct. 5, 2007. The entire disclosures of the above patent applications are hereby incorporated by reference.

FIELD OF THE INVENTION

The invention concerns flare munition for battlefield illumination.

BACKGROUND OF THE INVENTION

Flare munition for battlefield illumination is either shot from a weapon, for example, from a mortar (i.e., a flare grenade), or is dropped as a bomb from a missile (i.e., a flare bomb). Such flare munition consists, in essence, of a slowly burning pyrotechnic flare charge (for example, a magnesium compound), which is expelled from the respective munition casing after a specified running time and glides to earth with a parachute. The flare charge emits, during its descent, light in the visible and/or infra-red wave length range and thereby facilitates illumination of a target or reconnaissance of a target area.

When using known flare munition, it is one disadvantage, among others, that the pyrotechnic flare charge normally constitutes a hazard because it can unintentionally ignite or explode. In addition, burning pieces may separate and drop to the ground during burning of the flare while in downward flight, which is linked to increased fire risk and endangerment of persons and environment, as well as shortening of the burn time. If the flare charge is designed for infrared illumination of the battlefield, visible light is also unavoidably emitted as a result of the burning process, which is exactly what should be avoided because visible light interferes with the ability to view objects under infrared illumination. Finally the expense connected with clearance and rescue of pyrotechnical material is relatively large.

It is the object of the invention to provide flare munition that does not exhibit the drawbacks of conventional flare munition provided with pyrotechnic flare charges. In particular, the risk of unintentional burning of the flare charges shall safely be avoided in accordance with the present invention, with subsequent danger-free simple clearance and rescue of the respective flare body made more convenient.

SUMMARY OF THE INVENTION

The above object is solved according to the invention by the characteristics of flare munition for battlefield illumination, characterized in that the flare munition comprises at least one electrical flare body (2), an electrical energy source (7) connectable with the flare body (2), and an electrical or electronic control device (6) for connecting the electrical flare body (2) with the source of energy (7) during a specified time interval. Additional, particularly beneficial, embodiments of the invention are provided in accordance with the following subsidiary flare munition devices.

In accordance with a second flare munition embodiment of the invention, the first embodiment is modified so that the flare munition comprises an electrical flare body (2) that consists of at least one electrical illumination means (4). In accordance with a third embodiment of the present invention, the third embodiment is further modified so that the illumination means (4) can be light emitting diodes, halogen lamps, incandescent lamps or gas discharge lamps. In accordance with a fourth embodiment of the present invention, the first embodiment, the second embodiment, and the third embodiment, are further modified so that the illumination means (4) may be arranged in array-type manner.

In accordance with a fifth embodiment of the present invention, the first embodiment, the second embodiment, the third embodiment, and the fourth embodiment are further modified so that the source of energy (7) is designed in such a way that it will provide the flare body with the energy required for illumination only during the time interval while it is connected with flare body (2). In accordance with a sixth embodiment of the present invention, the first embodiment, the second embodiment, the third embodiment, the fourth embodiment, and the fifth embodiment, are further modified so that the source of energy (7) involves a thermal battery.

In accordance with a seventh embodiment of the present invention, the first embodiment, the second embodiment, the third embodiment, the fourth embodiment, the fifth embodiment and the sixth embodiment are further modified so that the flare munition comprises a parachute (1), suspended from which the electrical flare body (2), the electrical energy source (7) and the electrical or electronic control device (6) sink to the ground during the illumination of the battle, and that the control device (6) is designed in such manner that it does not electrically connect the energy source (7) with the flare body (2) until after the parachute (1) has opened up. In accordance with an eighth embodiment of the present invention, the first embodiment, the second embodiment, the third embodiment, the fourth embodiment, the fifth embodiment, the sixth embodiment, and the seventh embodiment, are further modified so that the flare munition comprises a system for reduction of parachute velocity, by means of which the electrical flare body (2), the electrical energy source (7) and the electrical or electronic control device (6) sink/fall in decelerated mode to the ground during battle illumination. In accordance with a ninth embodiment of the present invention, the first embodiment, the second embodiment, the third embodiment, the fourth embodiment, the fifth embodiment, the sixth embodiment, the seventh embodiment, and the eighth embodiment, are further modified so that the control device (6) is designed in such a manner that the energy source (7) will not provide electrical energy for the flare body (2) until after the flare munition is in descent.

The invention is essentially based on the concept of not using a pyrotechnic charge for the flare munition, but using an electrical flare body, which emits light in the visible and/or infrared wave length range, and which is connected to one of the energy sources delivering electrical energy to the flare body. In addition, the invention-specific flare munition comprises an electrical or electronic control device, which establishes the connection of the electrical flare body with the energy source during descent.

Utilization of an electrical flare body, in accordance with the present invention, definitely eliminates the unintentional reaction of a flare charge, and subsequent clearance and rescue of the flare body is simple and without risk. In addition, there is no danger that burning pieces may separate while the flare body is being dropped, which otherwise would lead to additional endangerment of people and the environment. Finally, the electrical flare bodies are able to generate light with a clearly defined wavelength range so that infrared illumination is possible without emitting unwelcome light in the visible range as well.

In the event of flare body utilization, it must be arranged launch-stable in a flare grenade, and the use of light emitting diodes (LED's) has primarily proven itself as beneficial as pyrotechnic flares. Furthermore, for the generation of correspondingly high luminous intensities for battlefield illumination, a multitude of light emitting diodes (for example 50-100 LED's) are employed in an array-type arrangement.

Needless to say, it is also possible to use halogen lights, incandescent lamps, or also gas discharge lamps, as flare bodies. To the extent that the launch-stable condition of the electrical illumination means is not warranted during the shooting of flare grenades from tube weapons, they can be used as flare bodies in flare bombs because the flare bodies, during dropping of these bombs from aircraft, are exposed to only relatively minor accelerations.

Because the energy source must provide its energy to the flare body only during a relatively brief time interval (e.g., with use of flare grenade approximately 30 seconds at an expulsion height of 200 m is required), a thermal battery or condenser battery is preferably employed as source of energy. Such types of batteries are generally launch-stable and capable, in spite of small space requirement, of providing sufficient energy within a brief period of time.

BRIEF DESCRIPTION OF THE DRAWING

Further details and benefits of the invention are apparent from the following working example, which is explained using the attached FIGURE showing flare munition for battlefield illumination in accordance with the present invention.

DETAILED DESCRIPTION OF THE INVENTION

The FIGURE schematically depicts a flare body 2 during its descent, wherein the flare body 2 has been expelled from a shell casing and is suspended from a parachute 1. The flare body 2 consists essentially of a cylindrical housing 3, and a support plate arranged at the bottom side of housing 3, with a multitude of array-like arranged light emitting diodes (LED's) 4, which illuminate a battle field 5.

The LED's 4 of the flare body 2 are connected by means of an electronic control device 6 with a thermal battery 7. The control device 6 causes that the supply of energy for the LED's 4 will not take place until after opening of the parachute 1, and only during the ensuing descent phase of flare body 2. In other words, the control device 6 operates to ensure that energy from the thermal battery 7 is not supplied to the LEDs 4 until after the parachute 1 has opened and only during the ensuing descent phase of the flare body towards the battlefield 5.

Needless to say, the invention is not limited to the represented exemplary embodiment of the FIGURE. The battery 7, the electronic control device 6, and the flare body 2 can also, for example, be arranged inside of the common housing, which is open at the bottom or closed by means of a light-permeable protective wall. Furthermore, a receiver can be provided at the common housing, which is coupled with parachute 1. In addition, instead of using a thermal battery as the battery 7, the present invention may be made to use a condenser battery, or also some other known storage media for electrical energy.

LISTING OF REFERENCE SYMBOLS

1 Parachute
2 Flare Body
3 Housing
4 LED, Light emitting Diode
5 Battle Field
6 Control Device
7 Battery, Thermal Battery, Energy Source

The invention claimed is:

1. Flare munition for battlefield illumination, wherein the flare munition comprises:

(a) at least one electrical flare body, wherein the at least one electrical flare body includes at least one electrical illumination means;

(b) an electrical energy source connectable with the at least one electrical flare body;

(c) an electrical or electronic control device for connecting the at least one electrical flare body with the source of energy during a specified time interval; and (d) a parachute, wherein the at least one electrical flare body, the electrical energy source and the electrical or electronic control device are suspended from the parachute while the flare munition sinks to the ground during illumination of a target, and wherein the control device operates so that the control device does not electrically connect the energy source with the at least one flare body until after the parachute has opened up.

2. Flare munition according to claim 1, wherein the illumination means comprises a plurality of light emitting diodes arranged in an array.

3. Flare munition according to claim 1, wherein the electrical energy source operates to provide the at least one flare body with energy required for illumination only during the specified time interval while the electrical energy source is operably connected with the flare body.

4. Flare munition according to claim 1, wherein the electrical energy source comprises a thermal battery.

5. Flare munition according to claim 1, wherein the flare munition further comprises:

(e) a system for reduction of parachute velocity, by means of which the at least one electrical flare body, the electrical energy source and the electrical or electronic control device sink in decelerated mode to the ground during target illumination.

6. Flare munition according to claim 1, wherein the electrical or electronic control device operates to control the energy source so that the energy source will not provide electrical energy for the at least one flare body until after the flare munition is in descent.

7. Flare munition according to claim 1, wherein the illumination means generates infrared illumination without emitting light in the visible range.

8. Flare munition according to claim 1, wherein the illumination means comprises a plurality of lamps arranged in an array.

9. Flare munition according to claim 1, wherein the electrical energy source comprises a condenser battery.

10. Flare munition according to claim 1, wherein the at least one electrical flare body emits light in a visible wave length range, or in an infrared wave length range, or in a wave length range that includes both the visible wave length range and the infrared wave length range.

11. Flare munition for battlefield illumination, wherein the flare munition comprises:

(a) at least one electrical flare body, wherein the at least one electrical flare body includes at least one electrical illumination means, and the at least one electrical illumination means is selected from the group consisting of light emitting diodes, halogen lamps, incandescent lamps and gas discharge lamps;

(b) an electrical energy source connectable with the at least one electrical flare body;

(c) an electrical or electronic control device for connecting the at least one electrical flare body with the source of energy during a specified time interval; and (d) a parachute, wherein the at least one electrical flare body, the electrical energy source and the electrical or electronic control device are suspended from the parachute while the flare munition sinks to the ground during illumination of a target, and wherein the control device operates so that the control device does not electrically connect the energy source with the at least one flare body until after the parachute has opened up.

12. Flare munition according to claim 11, wherein the electrical or electronic control device operates to control the energy source so that the energy source will not provide electrical energy for the at least one flare body until after the flare munition is in descent.

13. Flare munition for battlefield illumination, wherein the flare munition comprises:

(a) at least one electrical flare body, wherein the at least one electrical flare body includes at least one electrical illumination means, and the at least one electrical illumination means is selected from the group consisting of light emitting diodes, halogen lamps, incandescent lamps and gas discharge lamps;

(b) an electrical energy source connectable with the at least one electrical flare body;

(c) an electrical or electronic control device for connecting the at least one electrical flare body with the source of energy during a specified time interval;

(d) a parachute, wherein the at least one electrical flare body, the electrical energy source and the electrical or electronic control device are suspended from the parachute while the flare munition sinks to the ground during illumination of a target, and wherein the control device operates so that the control device does not electrically connect the energy source with the at least one flare body until after the parachute has opened up;

(e) a common housing, wherein the at least one electrical flare body, the electrical energy source and the electrical or electronic control device are arranged inside of the common housing; and (f) a shell casing from which the at least one electrical flare body is expelled before the parachute has opened up.

14. Flare munition according to claim 13, wherein the shell casing is a flare grenade shell casing configured for shooting from a tube weapon or a bomb shell casing configured for dropping from aircraft.

15. Flare munition according to claim 13, further comprising a receiver provided at one end of the common housing, wherein the receiver is coupled with the parachute.

* * * * *